United States Patent [19]

Kessel

[11] 4,263,138

[45] Apr. 21, 1981

[54] TRAP-TYPE DRAIN FITTING

[76] Inventor: Bernhard Kessel, Bahnhofstr. 31, 8071 Lenting, Fed. Rep. of Germany

[21] Appl. No.: 121,699

[22] Filed: Feb. 15, 1980

[51] Int. Cl.[3] ..... E03F 5/06

[52] U.S. Cl. ..... 210/163; 137/247.27; 137/247.45; 137/602

[58] Field of Search ..... 137/247.27, 247.31, 137/247.43, 247.45, 247.47, 602; 210/163, 164, 235 R

[56] References Cited

U.S. PATENT DOCUMENTS

| | | | |
|---|---|---|---|
| 871,836 | 11/1907 | Wade | 137/247.27 |
| 1,593,083 | 7/1926 | Kirchhan | 137/247.27 X |
| 2,938,437 | 5/1960 | Daley | 137/247.27 X |
| 3,042,210 | 7/1962 | Hattori | 210/163 |
| 3,066,802 | 12/1962 | Hoffler | 210/163 |

FOREIGN PATENT DOCUMENTS

| | | | |
|---|---|---|---|
| 169289 | 8/1934 | Switzerland | 137/247.27 |

*Primary Examiner*—Harold W. Weakley
*Attorney, Agent, or Firm*—Karl F. Ross

[57] ABSTRACT

A trap-type drain fitting is comprised of a base, an intermediate part, and an insert. The base has a lateral outlet connection and an outer wall having a base rim and an inner wall spaced radially inwardly from this outer wall. The intermediate part has an outer part edge complementarily interfitting with the base rim and with a part rim above and within the outer edge. This intermediate part also has a laterally extending inlet connection that can be positioned at any angle relative to the outlet connection of the base, and the inlet connection is connected to a downwardly extending inlet tube that opens at the bottom of the well formed by the inner wall of the base. Finally the insert sits on the part rim and has a downwardly extending tube that opens above the bottom of the well, so as to form a gas trap and a separate inlet for the fixture.

18 Claims, 5 Drawing Figures

Fig. 3
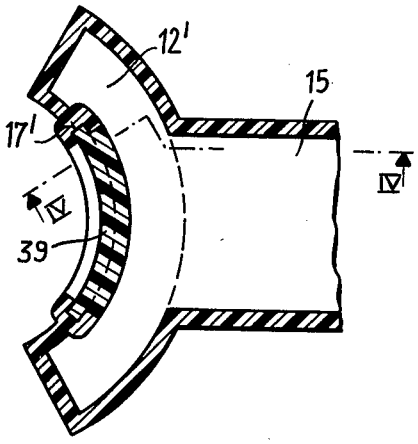
Fig. 5
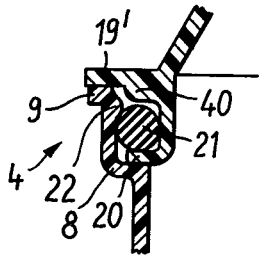
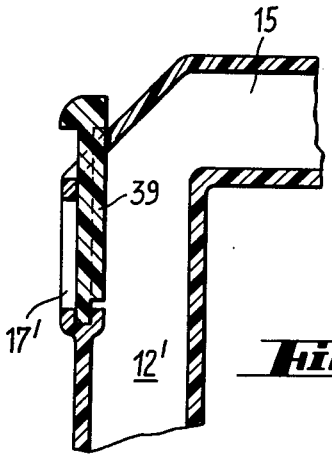
Fig. 4

TRAP-TYPE DRAIN FITTING

FIELD OF THE INVENTION

The present invention relates to a trap-type drain fitting. More particularly this invention concerns such a fitting which is connected to a drain or waste line and which not only constitutes a floor drain, but which also can act as a trap-type connector for an incoming waste line.

BACKGROUND OF THE INVENTION

A floor drain such as provided in a shower must incorporate a trap to prevent sewer gas from coming back out through the drain. In addition it is standard practice for such a trap-type drain to be provided with a second inlet, as for example connected to a sink. Thus a single fitting constitutes the trap both for the drain which it itself forms and for another plumbing fixture.

German utility model No. 7,732,624 describes such a trap-type drain wherein the inlet can be set at any angle relative to a vertical axis with respect to the outlet. To this end the housing is provided internally with a downwardly extending skirt which forms a trap with an upwardly extending wall region above which the drain is provided. As a result the fitting is relatively tall. Even when a standard drain screen is directly set into the central part of the drain housing the arrangement has a height which is normally equal to at least three times the internal height of the outlet. Nowadays with a relatively small distance between a ceiling and the overlying floor this height is extremely disadvantageous. Furthermore, sealing the various parts of this structure to each other is a difficult matter. Finally, producing such an element of synthetic resin is almost entirely impossible due to the difficulties in molding the complicated shape. Thus the device is expensive to manufacture as it must be built of several pieces.

OBJECTS OF THE INVENTION

It is therefore an object of the present invention to provide an improved trap-type drain which itself constitutes a drain, such as is usable in a shower, and which also can act as a trap for another inlet line or pipe.

Another object is to provide such a fitting which can be easily and inexpensively made, preferably by molding of a synthetic resin.

A further object is to provide such a drain fitting whose parts can easily be sealed relative to one another to ensure a long service life without leakage.

Yet another object is to provide such a drain fitting which can easily be serviced in the event it becomes clogged.

SUMMARY OF THE INVENTION

These objects are attained according to the instant invention in a trap-type drain fitting basically comprising three separate parts: a base, an intermediate part, and an insert. The base has a floor, an annular outer wall extending upwardly from the floor and having a circular annular base rim centered on an axis, an annular inner wall having an upper inner wall edge, forming with the floor a well, and forming with the floor with the outer wall an annular upwardly open compartment, and an outlet connection opening through the outer wall into the compartment at a level below the inner-wall edge. The intermediate part is above the compartment and has a circularly annular outer part edge complementarily interfitting with the base rim for rotation of the intermediate part about the axis on the base, an annular part rim generally centered on the axis above the part outer edge, an upright inlet tube having a lower end in the well below the inner-wall edge and an upper end above the inner-wall edge and below the part rim, and an inlet connection connected to the upper end of the tube and extending horizontally over the base rim between the part rim and the part outer edge. The insert has an outer insert edge complementarily interfittable with the part rim and a downwardly extending drain tube having a lower end in the well below the inner-wall edge and above the floor. Means including a bayonet coupling between the part rim and the outer insert edge sealingly locks the insert to the intermediate part.

According to further features of this invention the inlet connection has a restricted portion of substantially smaller flow cross section than the inlet tube. The inlet connection and the inlet tube are generally formed at the upper end of the inlet tube with an access hole and are provided with a plug normally blocking this access hole and normally braced into tight contact with the access hole by the intermediate part.

The system according to the instant invention has the drain tube combined with the inner wall to form a very effective trap that will completely prevent backflow of gases, while at the same time this structure adds very little to the overall vertical height of the assembly. In fact in spite of the auxiliary lateral inlet it is possible for this fitting according to the instant invention to have an overall height equal to at most twice the overall height of the outlet connection. The provision of the inlet connection with a restriction of its flow cross section and with a downwardly open tube ensures that waste water entering via this inlet connection will be accelerated at this region so that the water descending the inlet tube will create suction siphon-fashion in the inlet connection to increase the flow through it considerably, in spite of the restriction. What is more the vertically downwardly directed flow of water from the secondary inlet connection ensures an effective flushing of the bottom of the well so that deposits and the like are unlikely to sediment and solidify therein.

According to further features of this invention the inlet tube is substantially kidney-shaped, that is made to conform to the annular space between the drain tube and the inner wall. The flow cross section in the inlet tube can therefore be substantially greater than the flow cross section at the restriction of the inlet connection so that once again a flow is enhanced. The considerable flow cross section formed in the annular space between the drain tube and the inner wall ensures that the system according the instant invention can permit considerable drain flow.

Providing the access hole described above in horizontal alignment with the inlet connection and in vertical alignment with the inlet tube allows both of these parts to be cleared out relatively easily in the event of a clog. Thus it is possible to remove the insert by rotating it slightly to align its bayonet formations, and then simply run a snake up the inlet connection into the respective drain line. Thus even though the base and the intermediate part are normally cast right into place in the floor that houses the drain, it is a relatively easy matter to get a snake into either the inlet connection or the outlet connection once the insert is removed. The entire fitting is also normally formed of a synthetic resin which would have extremely smooth inner surfaces so that the deposits will not adhere to it.

According to this invention the various rims and outer edges are provided with the respective inwardly and outwardly open grooves that receive seals such as O-rings. This type of construction ensures, therefore, an excellent seal between the various parts at relatively low cost. What is more, the O-ring connection can easily be combined with the bayonet coupling to provide a good seal that can nonetheless be opened up if desired.

BRIEF DESCRIPTION OF THE DRAWING

FIG. 3 is a horizontal section through a detail of an alternative arrangement according to this invention;

FIG. 4 is a section taken along IV—IV of FIG. 3; and

FIG. 5 is a vertical section through another alternative detail according to this invention.

SPECIFIC DESCRIPTION

Figure 1:
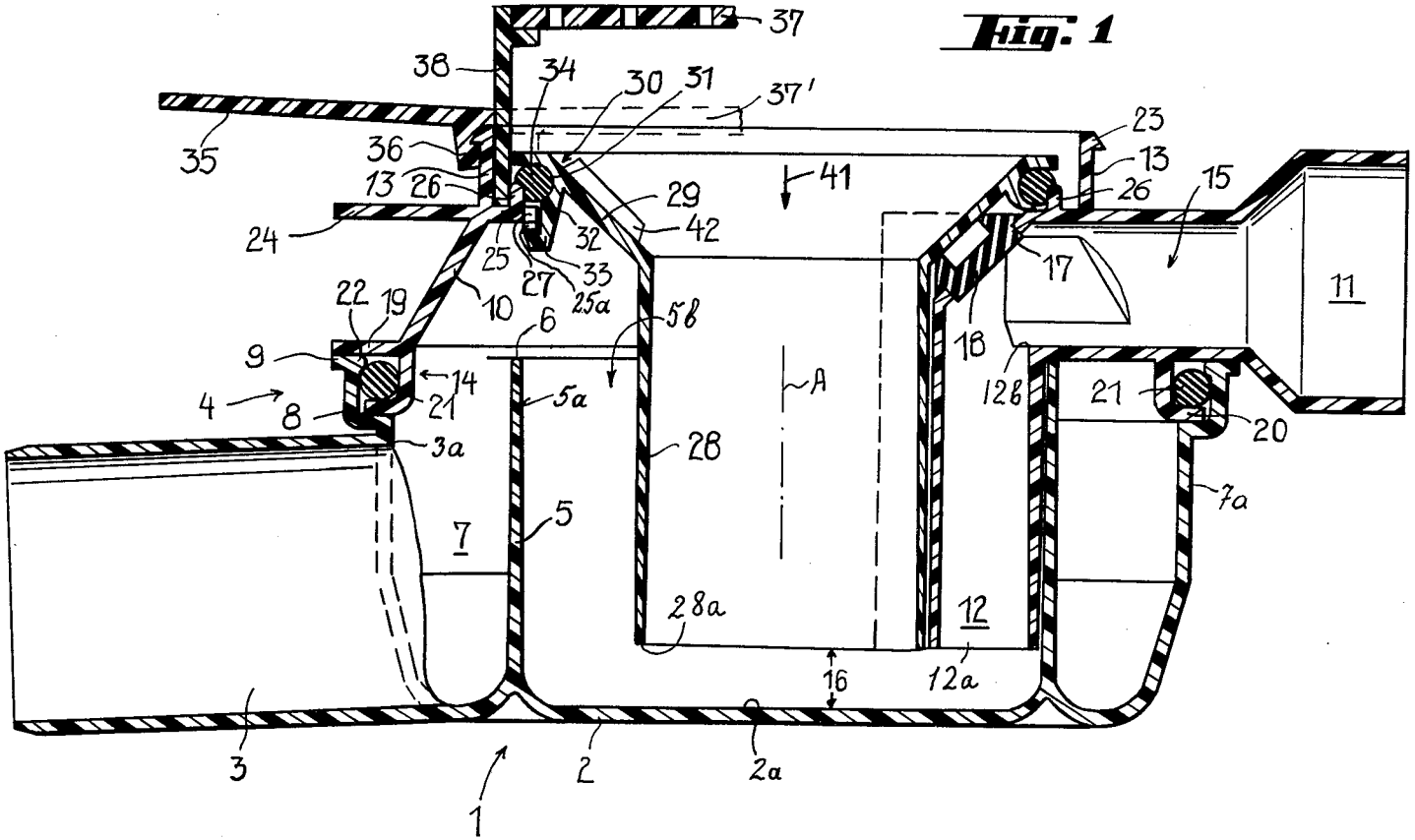
FIG. 1 is a vertical section through the fitting according to the instant invention.

As seen in FIG. 1 a trap-type drain fitting 1 according to the instant invention basically comprises:

a base 1 having a floor 2, an annular outer wall 7*a* extending upwardly from the floor 2 and having a circularly annular base rim 4 centered on an axis A, an annular inner wall 5 having an upper inner-wall edge 6, forming with the floor 2 a well 5*b*, and forming with the floor 2 and with the outer wall 7*a* an annular upwardly open compartment 7, and an outlet connection 3 opening through the outer wall 7*a* into the compartment 7 at a level below the inner-wall edge 6;

an intermediate part 10 above the compartment 7 and having a circularly annular outer part edge 14 complementarily interfitting with the base rim 4 for rotation of the intermediate part 10 about the axis A, an annular part rim 25 generally centered on the axis A above the part outer edge 14, an upright inlet tube 12 having a lower end 12*a* in the well 5*b* below the inner-wall edge 6 and an upper end 12*b* above the inner-wall edge 6 and below the part rim 25, and an inlet connection 11 connected to the upper end 12*b* of the tube 12 and extending horizontally over the base rim 4 between the part rim 25 and the part outer edge 14;

an insert 41 having an outer insert edge 30 complementarily interfittable with the part rim 25, and a downwardly extending drain tube 28 having a lower end 28*a* in the well 5*b* below the inner-wall edge 6 and above the floor 2; and means including a bayonet coupling 27, 33 between the part rim 25 and the outer insert edge 30 for sealingly locking the insert 28 to the intermediate part 10.

Figure 2:
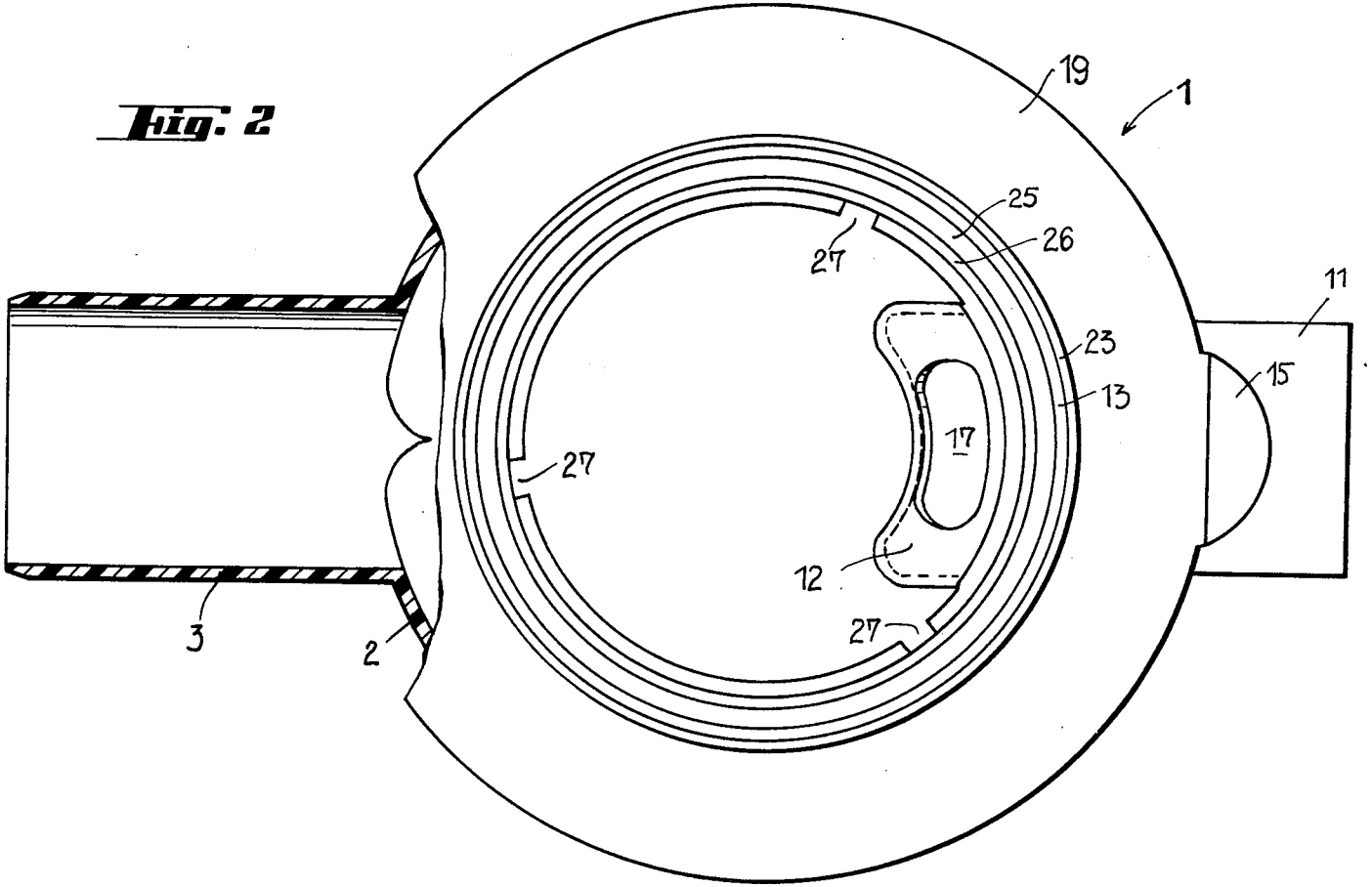
FIG. 2 is a partly broken away top view of the fitting of FIG. 1 with some parts removed for clarity of view.

More particularly, as seen in FIGS. 1 and 2 the outlet connection 3 has an upper wall 3*a* that is spaced well below the upper edge 6 of the inner wall 5. The lower end 28*a* of the tube 28 is spaced above the upper surface 2*a* of the floor 2 by a distance 16, and this lower end 28*a* is substantially level with the end 12*a*. The inner surface 5*a* of the outer wall 5 is spaced well outwardly from the tube 28 so that a relatively large flow cross section is ensured through the arrangement.

At the base rim 4 the base 2 is formed with a step 8 and above this step 8 with an outwardly directed flange 9 and an inwardly directed ridge 22. The ridge 22 and step 8 together form a groove that opens radially inwardly relative to the axis A. The outer edge 14 of the intermediate part 10 has an outwardly directed flange 19 that can rest atop the upper flange 9 of the rim 4 and a lower outwardly directed flange or lip 20 together forming an outwardly open groove receiving an O-ring seal 21. Thus when the intermediate part 10 is pressed down on the base 1 the seal 21 held in the groove between the flanges 19 and 20 will snap down over the ridge 22 to form a tight seal between the rim 4 and edge 14, and the seal 21 will normally resist axial separation of the base 1 and intermediate part 10.

The inlet connection 11 is formed with a restriction or region of reduced flow cross section 15 between the wall 5 and 7*a* and the inlet tube 12 as seen in FIG. 2 is of generally kidney-shaped cross section and of substantially larger flow cross section than the restriction 15. An access hole 17 is open at the elbow between the restriction 15 and tube 12 and is normally fitted with an elastomeric plug 18 that is held tightly in place in the hole 17 by frustoconical wall portion 29 of the insert 41. This hole 17 is therefore horizontally aligned with the inlet connection 11 and vertically aligned with tube 12 so that either of these parts can be snaked out through this hole 17.

The intermediate part 10 has an inwardly directed flange constituting the part rim 25 and an outwardly directed flange 24 surrounding it and at a level exactly equal to the level of the top of the restriction 15. Extending upwardly from the flange 25 forming the rim is a lip 26, and spaced radially outwardly from this lip 26 is another rim or lip 13 formed at its upper outer edge with a ridge or barb 23. The insert edge 40 has a ridge 32 forming a groove 31 receiving another O-ring 34 that is engageable with the lip 26 to form a right seal between the insert 41 and the intermediate part 10. In addition extending downwardly from the outer insert edge 30 is a plurality of tabs 33 engageable through notches 27 in the flanges 25 to form the above-mentioned bayonet coupling 27, 33.

A ring 35 is provided with formations 36 engageable over the ridge or securing formation 23 for integrating the fitting according to the instant invention into a floor or plumbing fixture. Thus, for instance, the ring 35 could actually be the center portion of an integral molded shower or tub base. In the event that the fitting is recessed in the floor it is possible for an extension sleeve 38 to stand between the lips 26 and 13 on the intermediate part 10 and to in turn support a screen 37. The screen 37 may also be positioned at 37′ lower down directly on the insert 41.

FIGS. 3 and 4 show how the tube 12 can be replaced by a tube 12′ formed as a segment of a circular annulus, and with a guide hole 17′ receiving a slidable plug 39. This plug 39 is held down tightly in hole 17′ to block it by the frustoconical wall portion 29 as is the plug 17 of FIG. 1.

It is also possible as shown in FIG. 5 to form the intermediate part with a flange 19′ having a ridge 40 that holds the seal 21 down. The rim 4 is similarly formed so that the seal 21 not only prevents leakage between the base 2 and intermediate part 10, but it also acts to hold these two parts together axially.

The arrangement according to the instant invention is extremely advantageous in that the inlet connection 11 can be directed at any radial orientation from the axis a relative to the outlet connection 3. It can either be diametrically opposite as shown in FIG. 1, one above the other and parallel, or at any relative angle to each other.

The fitting will operate effectively in any position. What is more it is possible very easily to integrate this fitting into a plumbing fixture, or to cast it into a floor. The ring 35 can be finished to match whatever fixture the fitting is used with, or can in fact be integrated right into the fixture.

The entire thing is made of durable synthetic resin. Its various parts are of relatively simple shape and can be easily formed by injection molding without the use of complex molds. Thus production costs are relatively low. At the same time an extremely good seal is assured between the various parts so that once installed leakage is virtually impossible.

I claim:

1. A trap-type drain comprising:

a base having a floor, an annular wall extending upwardly from said floor and having a circularly annular base rim centered on an axis, an annular inner wall having an upper inner-wall edge, forming with said floor a well, and forming with said floor and said outer wall an annular upwardly open compartment, and an outlet connection opening through said outer wall into said compartment at a level below said inner-wall edge;

an intermediate part above said compartment and having a circularly annular part outer edge complementarily interfitting with said base rim for rotation of said intermediate part about said axis, an annular part rim generally centered on said axis above said part outer edge, an upright inlet tube having a lower end in said well below said inner-wall edge and an upper end above said inner-wall edge and below said part rim, and an inlet connection connected to said upper end of said tube and extending horizontally over said base rim between said part rim and said part outer edge;

an insert having an outer insert edge complementarily interfittable with said part rim, and a downwardly extending drain tube having a lower end in said well below said inner-wall edge and above said floor; and means including a bayonet coupling between said part rim and said outer insert edge for sealingly locking said insert to said intermediate part.

2. The fitting defined in claim 1 wherein said inlet connection has a restricted portion of substantially smaller flow cross section than said inlet tube.

3. The fitting defined in claim 2 whrein said inlet connection and inlet tube are formed generally at said upper end of said inlet tube with an access hole and are provided with a plug normally blocking said access hole.

4. The fitting defined in claim 3 wherein said plug is normally braced into tight contact with said access hole by said intermediate part.

5. The fitting defined in claim 1 wherein said insert is formed between said drain tube and said outer insert edge as a generally upwardly flared frustoconical wall, said insert outer edge forming a radially outwardly open groove, said means including a seal ring in said groove.

6. The fitting defined in claim 5 wherein said outer insert edge is formed with outwardly directed tabs and said part rim is formed with inwardly open notches in which said tabs are engageable and which form with said tabs said bayonet coupling.

7. The fitting defined in claim 1 wherein said insert is formed internally with inwardly projecting formations, said insert otherwise being rotation-symmetrical about said axis.

8. The fitting defined in claim 1 wherein said inlet connection is formed with a restriction only generally above said well and said inlet tube is of larger flow cross section than said inlet connection at said restriction.

9. The fitting defined in claim 8 wherein said inlet tube is generally of kidney-shaped cross section and extends down in said compartment to the level of said lower end of said drain tube.

10. The fitting defined in claim 1 wherein said inlet connection and inlet tube are formed generally at said upper end of said inlet tube with an access hole and are provided with a plug normally blocking said access hole, said access hole being horizontally aligned with said inlet connection and vertically aligned with said inlet tube.

11. The fitting defined in claim 10 wherein said plug is constituted as a vertically slidable slider, said insert holding said slider in a position blocking said access hole when interfitted with said intermediate part.

12. The fitting defined in claim 1 wherein said base rim is formed with an inwardly open circumferential groove and said outer part edge is formed with an outwardly open circumferential groove alignable with said groove of said base, said grooves receiving an annular seal ring in snug radial contact with said base and said intermediate art.

13. The fitting defined in claim 1 wherein said intermediate part is formed with an annular upwardly standing lip having outwardly directed securing formations.

14. The fitting defined in claim 13 wherein said intermediate part is provided with a ring snap fitted to said securing formations.

15. The fitting defined in claim 13, further comprising a screen above said insert and having a downwardly extending support sleeve standing on said intermediate part immediately adjacent said outer insert edge.

16. The fitting defined in clam 1 wherein said part rim is of substantially smaller diameter than said part outer edge.

17. The fitting defined in claim 1 wherein said base, intermediate part, and insert are made of a synthetic resin and each is one unitary piece.

18. The fitting defined in claim 1 wherein except for said outlet connection said base is rotation symmetrical about said axis, said intermediate part being rotation symmetrical about said axis except for said inlet connection, said insert being rotation symmetrical about said axis except for said bayonet coupling.

* * * * *